US008080753B2

(12) United States Patent
Yeh et al.

(10) Patent No.: US 8,080,753 B2
(45) Date of Patent: Dec. 20, 2011

(54) INPUT APPARATUS AND KEYSWITCH

(75) Inventors: Liang-Ta Yeh, Shulin (TW); Chih-Chung Yen, Bade (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 267 days.

(21) Appl. No.: 12/552,355

(22) Filed: Sep. 2, 2009

(65) Prior Publication Data

US 2010/0051431 A1 Mar. 4, 2010

(30) Foreign Application Priority Data

Sep. 3, 2008 (TW) ..... 97215891 U

(51) Int. Cl.
*H01H 3/12* (2006.01)

(52) U.S. Cl. ..... 200/341

(58) Field of Classification Search ..... 200/314, 200/302.2, 341, 5 A; 205/118, 120, 122
See application file for complete search history.

(56) References Cited

U.S. PATENT DOCUMENTS 7,364,649 B2 * 4/2008 Kunthady et al. ..... 205/118
7,449,642 B1 * 11/2008 Wu et al. ..... 200/5 A
7,735,214 B2 * 6/2010 Wu et al. ..... 29/622

* cited by examiner

*Primary Examiner* — Edwin A. Leon
(74) *Attorney, Agent, or Firm* — Winston Hsu; Scott Margo

(57) ABSTRACT

The invention provides a keyswitch. The keyswitch comprises a keycap, an adhesive layer, an electroplated layer, and a protecting layer. The adhesive layer has at least one color and covers the keycap. The electroplated layer covers the adhesive layer. After a part of the protecting layer and the electroplate layer is removed, a cave is formed on the keyswitch surface to show the at least one color.

19 Claims, 4 Drawing Sheets

INPUT APPARATUS AND KEYSWITCH

BACKGROUND OF THE INVENTION

1. Field of the Invention

The present invention generally relates to a keyswitch, and more particularly, to a keyswitch processed by a special surface treatment and an input apparatus having the keyswitch.

2. Description of the Prior Art

With the development of technology, the information device has become popular. Taking the computer for an example, there are various brands and styles of computer in the market, and they are also widely applied in families, companies, offices, schools, and other places. The computer has become a necessity in people's daily life. A keyboard is collocated in a well-known computer, such as a desktop and a notebook, to provide users inputting characters or other operations.

However, as to a keyswitch of a general keyboard, a keycap of the keyswitch is usually made without a special design or a surface treatment, and the character or the symbol represented by each keycap is usually directly printed upon the keycap so that only a monotonic color (e.g., black) is shown. Nowadays, it is no longer attractive to consumers. Additionally, as time goes by, the character or the symbol shown on the keycap will be gradually ground so that it is hard for the user to recognize what the keyswitch represents when he/she operates the keyboard.

Therefore, the invention provides a keyswitch and an input apparatus having the keyswitch via the special surface treatment to solve the above-mentioned questions.

SUMMARY OF THE INVENTION

Accordingly, an aspect of the present invention is to provide a keyswitch and an input apparatus having the keyswitch processed by a special surface treatment. The surface of the keyswitch has metallic texture, and characters or symbols having different colors shown upon the keyswitch are not easily ground.

A first embodiment of the invention is a keyswitch. Practically, the keyswitch can be applied to a keyboard. The keyswitch includes a keycap, an adhesive layer, an electroplated layer, and a protecting layer. Wherein the adhesive layer, the electroplated layer, and the protecting layer are formed upon the surface of the keycap via a special surface treating process.

In this embodiment, the keycap has a light transmissibility. The adhesive layer has at least one color covering the keycap. The electroplated layer is covered upon the adhesive layer. The protecting layer is covered upon the electroplated layer. After a part of the protecting layer and the electroplated layer is removed, a cave will be formed on the keyswitch surface to show the at least one color.

In practical applications, the adhesive layer can be covered upon the keycap via a spray coating method; the electroplated layer can be covered upon the adhesive layer via a method of water plating, an evaporative deposition, or a sputtering deposition.

In this embodiment, the protecting layer on the uppermost layer of the keyswitch surface is used to increase an abrasion resistance of the keyswitch. And the cave of the keyswitch surface can be formed by removing the part of the protecting layer and the electroplated layer via a laser etching method.

Additionally, in order to make the keyswitch surface to show a special pattern (e.g., a character or a symbol) corresponding to the keyswitch, the shape of the cave upon the keyswitch surface will correspond to a specific pattern of the keyswitch, and at least one color is formed upon the adhesive layer via a dyeing method. Therefore, the color of the character or the symbol of the keyswitch surface can be changed by adjusting the dyeing color of the adhesive layer.

A second embodiment of the invention is an input apparatus. Practically, the input apparatus can be a keyboard used to operate a desktop, a notebook, or other electrical devices.

In this embodiment, the input apparatus includes a substrate, and a plurality of keyswitches. Each of the keyswitches includes a keycap, an adhesive layer, an electroplated layer, and a protecting layer. Wherein the adhesive layer, the electroplated layer, and the protecting layer are formed upon the surface of the keycap via a special surface treating process. The keycap has a light transmissibility. The adhesive layer has at least one color covering the keycap. The electroplated layer is covered upon the adhesive layer. The protecting layer is covered upon the electroplated layer. After a part of the protecting layer and the electroplated layer is removed, a cave will be formed on the keyswitch surface to show the at least one color.

In practical applications, the adhesive layer can be covered upon the keycap via a spray coating method; the electroplated layer can be covered upon the adhesive layer via a method of water plating, an evaporative deposition, or a sputtering deposition.

In this embodiment, the protecting layer on the uppermost layer of the keyswitch surface is used to increase an abrasion resistance of the keyswitch. And, the cave of the keyswitch surface can be formed by removing the part of the protecting layer and the electroplated layer via a laser etching method.

Additionally, in order to make the keyswitch surface to show a special pattern (e.g., a character or a symbol) corresponding to the keyswitch, the shape of the cave upon the keyswitch surface will correspond to a specific pattern of the keyswitch, and at least one color is formed upon the adhesive layer via a dyeing method. Therefore, the color of the character or the symbol of the keyswitch surface can be changed by adjusting the dyeing color of the adhesive layer.

Compared to the prior art, the keyswitch and the input apparatus having the keyswitch of the invention is made through a special surface treating process, so that the surface of the keyswitch has special metallic texture, and a character or a symbol shown upon the keyswitch is not easily ground.

Additionally, the keyswitch of the invention can change the showing color of the character or the symbol of the keyswitch by adjusting the color of the adhesive layer. Therefore, the input apparatus having the keyswitch has larger market competitiveness, and consumers enjoying a new and innovative tendency can be also satisfied.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

Figure 3A:
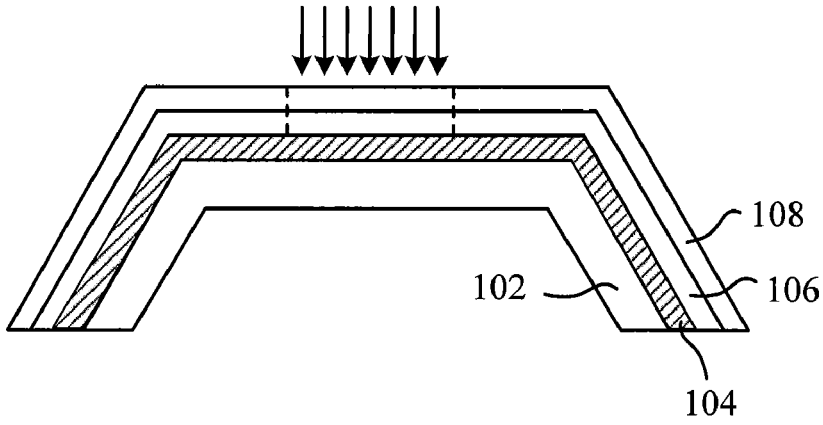
Figure 3B:
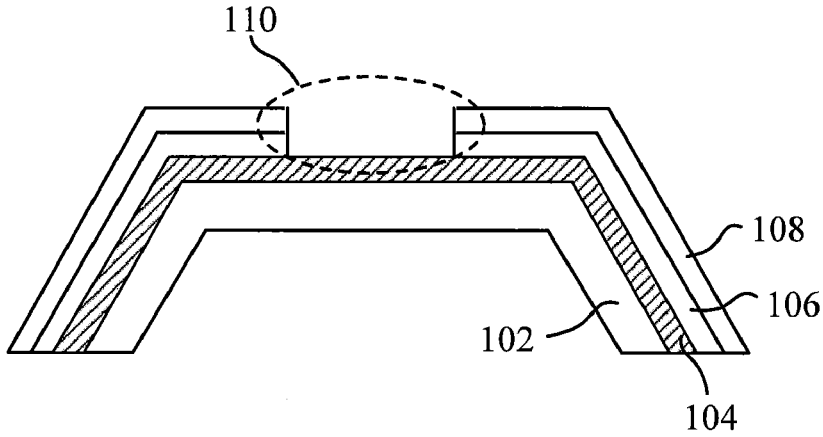
Figure 3C:
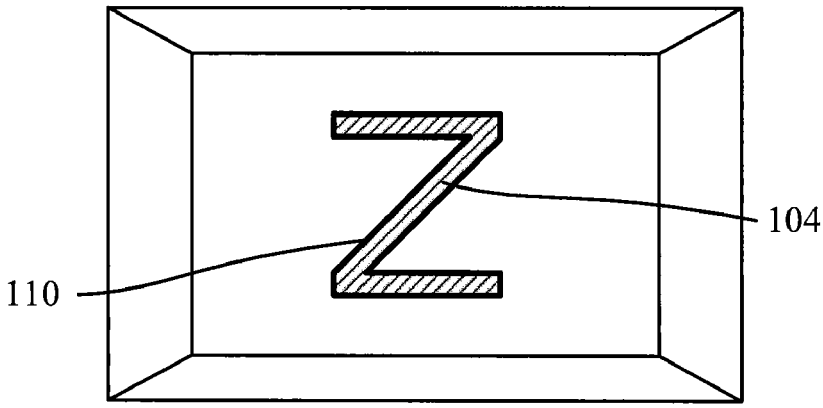

FIG. 3(A) to FIG. 3(C) illustrates an example of the cave formed on the keycap surface.

Figure 4:
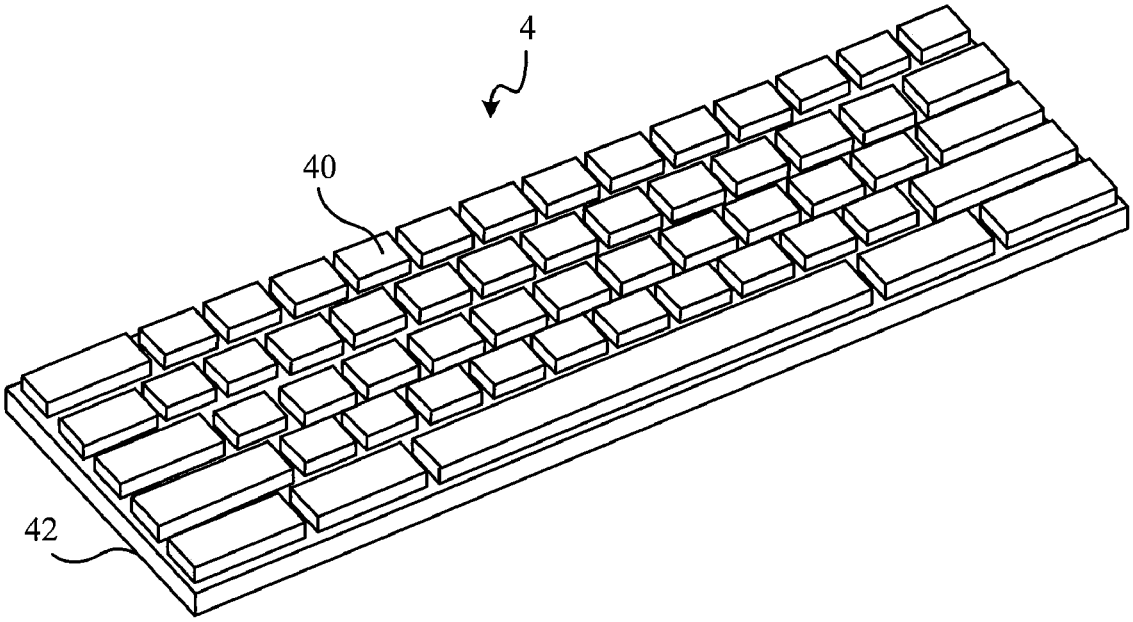

FIG. 4 illustrates a surface view of the input apparatus according to the second embodiment of the invention.

Figure 5:
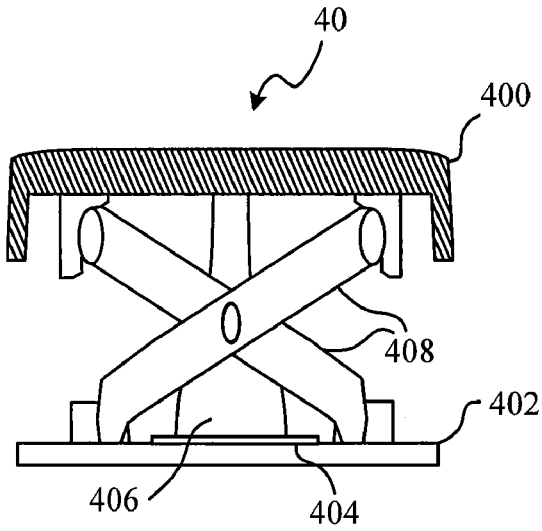

FIG. 5 illustrates a schematic diagram of the structure of the keyswitch in FIG. 4.

Figure 6:
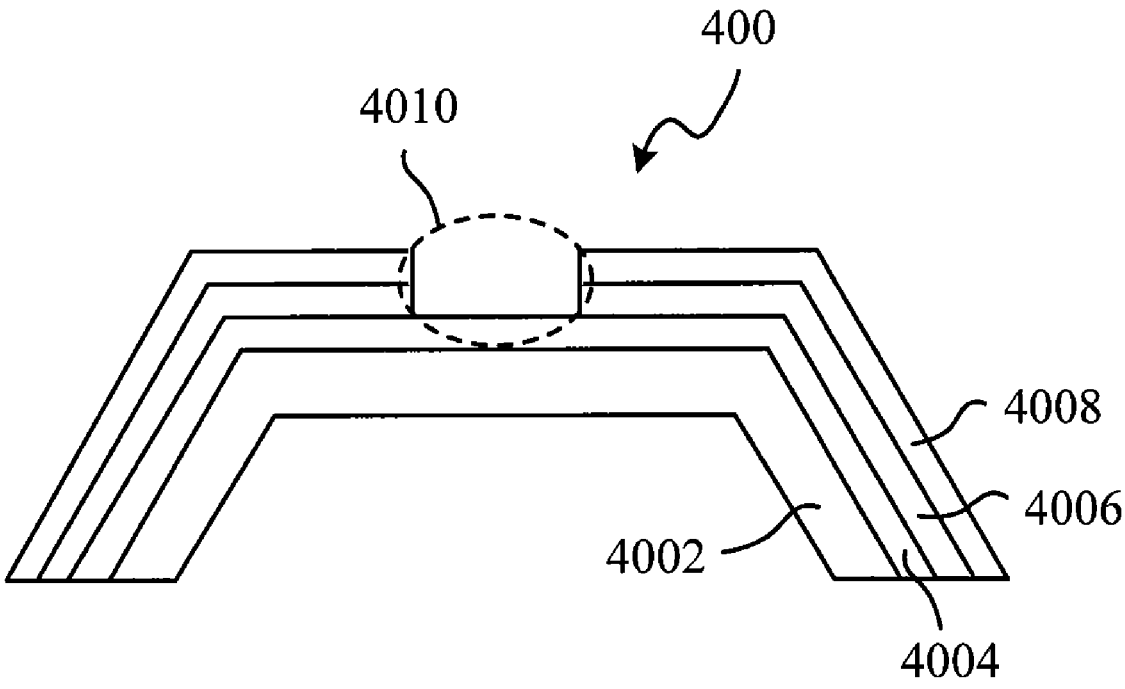

FIG. 6 illustrates a detailed structure schematic diagram of the keycap in FIG. 5.

DETAILED DESCRIPTION OF THE INVENTION

The present invention provides a keyswitch and an input apparatus having the keyswitch processed by a special surface treatment. Practically, the input apparatus can be a keyboard used to operate a desktop, a notebook, or other electrical devices.

According to the keyswitch of the invention is made through an electroplating process so that the keyswitch surface has the special metallic texture. Additionally, a character or a symbol with different colors shown upon the keyswitch of the invention is not easily ground via the special design and the surface treatment process.

Figure 1:
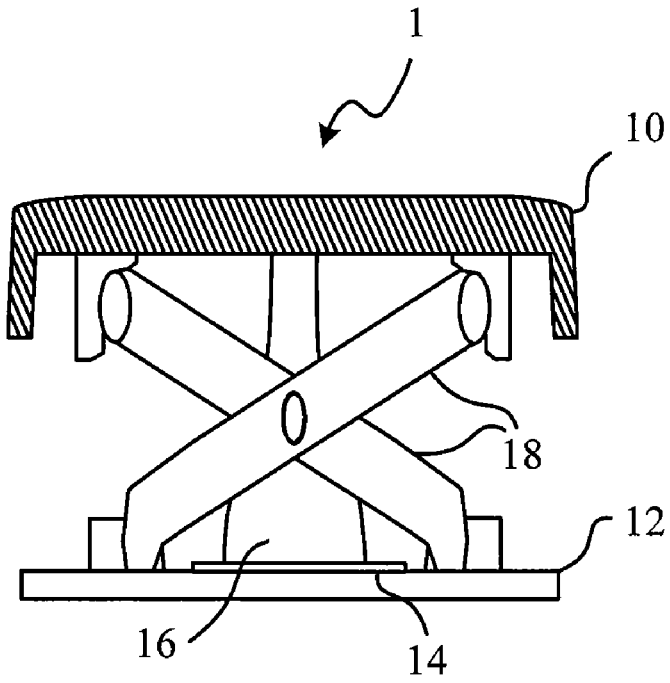
FIG. 1 illustrates a schematic diagram of the structure of the keyswitch according to the first embodiment of the invention.

A first embodiment of the invention is a keyswitch. Practically, the keyswitch can be applied to the keyboard. Please refer to FIG. 1. FIG. 1 illustrates a schematic diagram of the structure of the keyswitch 1. As shown in FIG. 1, the keyswitch 1 includes a keycap 10, a substrate 12, a flexible circuit board 14, a rubber circular cap 16, and a scissors structure 18.

In this embodiment, when the keyswitch 1 is pressed by an external force, the keycap 10 will be moved downward to make the rubber circular cap 16 strained, so that a touching end located in the rubber circular cap 16 will touch a switch of the flexible circuit board 14 to turn.

In practical applications, whether the switch of the flexible circuit board 14 can touch the touching end of the rubber circular cap 16 is the key to reach the character inputting or other functions. Besides, when the original external force pressing on the keyswitch 1 is disappeared, the function of the scissors structure 18 can help the keyswitch 1 return to its original position. The operation state of the keyswitch 1 is the same with that of the general keyswitch, so it is no longer explained here.

Figure 2:
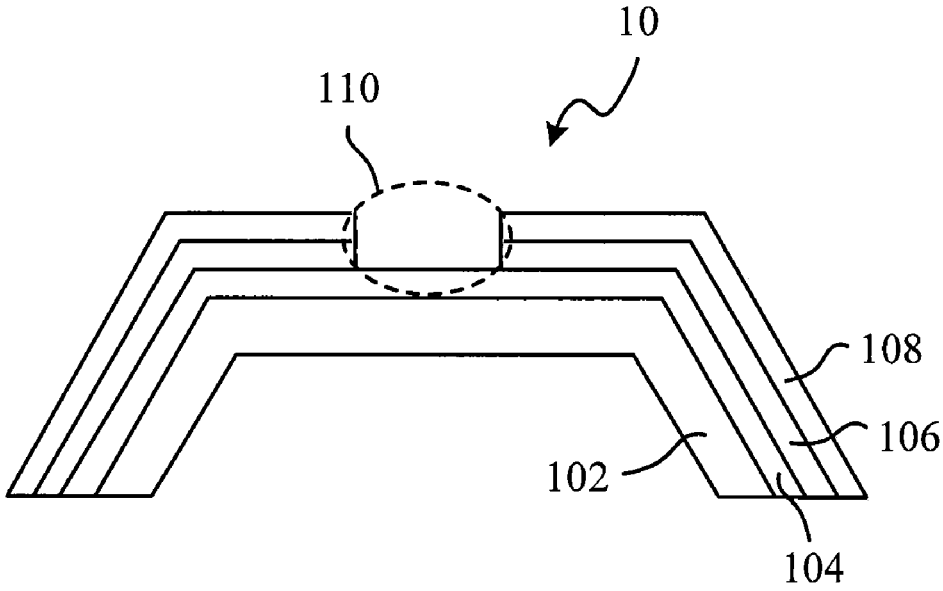
FIG. 2 illustrates a detailed structure schematic diagram of the keycap in FIG. 1.

Next, the main characteristics of the invention will be introduced in detail. Please refer to FIG. 2. FIG. 2 illustrates a detailed structure schematic diagram of the keycap 10 in FIG. 1. As shown in FIG. 2, the keycap 10 includes a keycap body 102, an adhesive layer 104, an electroplated layer 106, a protecting layer 108, and a cave 110.

In this embodiment, the adhesive layer 104, the electroplated layer 106, and the protecting layer 108 of the above-mentioned are formed upon the surface of the keycap body 102 in series via several surface treatment processes.

Next, the keycap 10 having each layer structure and function will be explained to form bottom to top in series.

Firstly, in this embodiment, the keycap body 102 of the keycap 10 has a light transmissibility. Therefore, the keycap body 102 can include a silica gel material, an acrylic material, or other light transmissibility materials.

Secondarily, the adhesive layer 104 is covered upon the keycap body 102 of the keycap 10. Practically, the adhesive layer 104 can be covered upon the keycap body 102 via a spray coating method. In this embodiment, the surface of the keycap body 102 may have many uneven spots; therefore, the function of the adhesive layer 104 is filled with these uneven spots to make the surface of the keycap body 102 smoother.

Additionally, because the electroplated layer 106 directly adhered to the surface adhesion of the keycap body 102 is not good, the adhesive layer 104 is covered upon the surface of the keycap body 102, which makes the electroplated layer 106 formed in the follow-up process be more closely adhered onto the surface of the keycap body 102.

It should be noticed that the adhesive layer is different from the general transparent adhesive layer; in this embodiment, the adhesive layer 104 of the keycap 10 has one or varied colors, such as red, blue, red and green interaction, or different color assemblages. Practically, the color is formed in the adhesive layer 104 via a dyeing method; namely, the dyestuffs with various kinds of colors are added to the material of the adhesive layer 104 so that the adhesive layer 104 can have different colors.

Next, the electroplated layer 106 is covered upon the adhesive layer 104. In this embodiment, the electroplated layer 106 includes metallic material, and it can be formed upon the adhesive layer 104 via a water plating method, an evaporative deposition method, a sputtering deposition method, or other electroplating methods. As the above-mentioned, the adhesive layer 104 is located between the electroplated layer 106 and the surface of the keycap body 102, so that the electroplated layer 106 can be more closely adhered onto the surface of the keycap body 102.

Finally, the protecting layer 108 is covered upon the electroplated layer 106. Practically, the protecting layer 108 can be a general UV dyestuff of the keyboard, and the protecting layer 108 is used to cover the keyswitch 1 surface for increasing an abrasion resistance of the keyswitch 1 surface.

The cave 110 of the keycap 10 can be formed by removing a part of the protecting layer 108 and the electroplated layer 106 upon the keycap 10. In this embodiment, the purpose of forming the cave 110 upon the surface of the keycap 10 is to show the adhesive layer 104 in the region of the cave 110. The adhesive layer 104 has one or several colors; thus, these colors can be showed in the region of the cave 110.

In practical applications, the cave 110 can be formed via a laser etching method to remove the part of the protecting layer 108 and the electroplated layer 106. Additionally, in order to make the keycap 10 surface show a representing pattern (e.g., a character or a symbol), the shape of the cave 110 formed on the keycap 10 will correspond to the pattern represented by the keyswitch 1.

Please refer to FIG. 3(A)-FIG. 3(C). FIG. 3(A)-FIG. 3(C) illustrates an example of the cave formed on the keycap surface. As shown in FIG. 3(A), after the above-mentioned surface treatment processes are performed, the adhesive layer 104, the electroplated layer 106, and the protecting layer 108 are formed upon the keycap body 102 surface in series. At this time, the part of the protecting layer 108 and the electroplated layer 106 can be removed by a laser etching method according to the pattern represented by the keyswitch 1.

As shown in FIG. 3(B), at this time, the color of the adhesive layer 104 can be shown in the region of the cave 110. If the pattern represented by the keyswitch 1 is Z, FIG. 3(C) shows a top view diagram of the keyswitch 1 and the slash part shows the color of the adhesive layer 104.

To sum up, after the special design and the surface treatment process, the keyswitch 1 of this embodiment has the surface of the metallic texture, additionally, the character or the symbol on the surface of the keyswitch 1 is not easily ground, and these characters or symbols can show different colors.

According to a second embodiment is an input apparatus. Practically, the input apparatus can be a keyboard. Please refer to FIG. 4. FIG. 4 illustrates a surface view of the input apparatus. As shown in FIG. 4, the input apparatus 4 includes a substrate 42, and a plurality of keyswitches 40 located on the substrate 42.

Please refer to FIG. 5. FIG. 5 illustrates a schematic diagram of the structure of the keyswitch 40 in FIG. 4. As shown in FIG. 5, the keyswitch 40 includes a keycap 400, a substrate 402, a flexible circuit board 404, a rubber circular cap 406, and a scissors structure 408.

In this embodiment, when the keyswitch 40 is pressed by the external force, the keycap 400 will be moved downward to make the rubber circular cap 406 strained, so that a touching end located in the rubber circular cap 406 will touch a switch of the flexible circuit board 404 to turn, and finally to reach the character inputting or other functions. When the original external force pressed on the keyswitch 40 is disappeared, the function of the scissors structure 408 can make the keyswitch 40 returned to the original position. The operation state of the keyswitch 40 is the same with that of the general keyswitch, so it is no longer explained here.

Next, please refer to FIG. 6. FIG. 6 illustrates a detailed structure schematic diagram of the keycap 400 in FIG. 5. As shown in FIG. 6, the keycap 400 includes a keycap body 4002, an adhesive layer 4004, an electroplated layer 4006, a protecting layer 4008, and a cave 4010. In this embodiment, the adhesive layer 4004, the electroplated layer 4006, and the protecting layer 4008 mentioned above are formed upon the surface of the keycap body 4002 in series via several surface treating processes.

In this embodiment, the keycap body 4002 has a light transmissibility. Thus, the keycap body 4002 can include a silica gel material, an acrylic material, or other light transmissibility materials.

The adhesive layer 4004 can be covered upon the keycap body 4002 via a spray coating method. The adhesive layer 4004 is used to fill the uneven spots of the keycap body 4002 surface to make the keycap body 4002 surface smoother. Additionally, the electroplated layer 4006 not only can be formed upon the adhesive layer 4004 in the follow-up processes, but also can be more closely adhered onto the surface of the keycap body 4002.

It should be noticed that the adhesive layer 4004 has one or several colors, such as red, blue, red and green interaction, or different color assemblages, in this embodiment. Practically, the color is formed in the adhesive layer 4004 via a dyeing method; namely, the dyestuffs with various kinds of colors are added to the material of the adhesive layer 4004 so that the adhesive layer 4004 has different colors.

Next, the electroplated layer 4006 is covered upon the adhesive layer 4004. In this embodiment, the electroplated layer 4006 includes metallic material and it can be formed upon the adhesive layer 4004 via a water plating method, an evaporative deposition method, a sputtering deposition method, or other electroplating methods. As mentioned above, the adhesive layer 4004 is located between the electroplated layer 4006 and the keycap body 4002 surface, so that the electroplated layer 106 can be more closely adhered onto the surface of the keycap body 4002.

Finally, the protecting layer 4008 is covered upon the electroplated layer 4006. Practically, the protecting layer 4008 can be a general UV dyestuff of the keyboard or other dyestuffs, the protecting layer 4008 is used to cover keyswitch 40 surface for increasing an abrasion resistance of the keyswitch 40 surface.

The cave 4010 of the keycap 400 can be formed by removing a part of the protecting layer 4008 and the electroplated layer 4006 upon the keycap 400. In this embodiment, the purpose of forming the cave 4010 upon the surface of the keycap 400 is to show the adhesive layer 4004 in the region of the cave 4010. The adhesive layer 4004 has one or several colors; thus, these colors can be shown in the region of the cave 4010.

In practical applications, the cave 4010 can be formed via a laser etching method to remove the part of the protecting layer 4008 and the electroplated layer 4006. Additionally, in order to make the surface of the keycap 400 show a representing pattern (e.g., a character or a symbol), the cave 4010 formed on the keycap 400 will correspond to the pattern represented by the keyswitch 40.

Practically, the laser etching method can not only use, but also perform the removed action of the part of the protecting layer 4008 and the electroplated layer 4006 by other etching methods, but not limited to this.

To sum up, after the special design and the surface treating process, the keyswitch 40 of the input apparatus 4 of this embodiment has the surface of the metallic texture. Additionally, the character or the symbol on the surface of the keyswitch 40 is not easily ground, and these characters or symbols can show different colors.

Compared to the prior art, the keyswitch and the input apparatus having the keyswitch of this invention is made through the special surface treating process, so that the surface of the keyswitch has special metallic texture, and a character or a symbol shown upon the keyswitch is not easily ground. Additionally, according to the keyswitch of the invention, the showing color of the character or the symbol of the keyswitch can be changed by adjusting the color of the adhesive layer; thus, the input apparatus having the keyswitch has larger market competitiveness, and the consumers enjoying a new and innovative tendency can be also satisfied.

Although the present invention has been illustrated and described with reference to the preferred embodiment thereof, it should be understood that it is in no way limited to the details of such embodiment but is capable of numerous modifications within the scope of the appended claims.

What is claimed is:

1. A keyswitch, comprising:

a keycap body, having a light transmissibility;

an adhesive layer, covered upon the keycap body, the adhesive layer having at least one color;

an electroplated layer, covered upon the adhesive layer; and a protecting layer, covered upon the electroplated layer;

wherein the adhesive layer is for making a surface of the keycap body smooth so that the electroplated layer is closely adhered above the surface of the keycap body, and after a part of the protecting layer and the electroplated layer is removed, a cave is formed on the keyswitch surface to show the at least one color.

2. The keyswitch of claim 1, wherein the adhesive layer is covered upon the keycap body via a spray coating method.

3. The keyswitch of claim 1, wherein the at least one color is formed upon the adhesive layer via a dyeing method.

4. The keyswitch of claim 1, wherein the electroplated layer is covered upon the adhesive layer via a water plating method.

5. The keyswitch of claim 1, wherein the electroplated layer is covered upon the adhesive layer via an evaporative deposition method.

6. The keyswitch of claim 1, wherein the electroplated layer is covered upon the adhesive layer via a sputtering deposition method.

7. The keyswitch of claim 1, wherein the protecting layer is used to increase an abrasion resistance of the keyswitch.

8. The keyswitch of claim 1, wherein the part is removed via a laser etching method to form the cave.

9. The keyswitch of claim 1, wherein the shape of the cave disposed upon the keyswitch surface corresponds to a specific pattern of the keyswitch.

10. An input apparatus, comprising:

a substrate; and at least one keyswitch, located on the substrate, a specific keyswitch of the at least one keyswitch comprising:

a keycap body, having a light transmissibility;

an adhesive layer, covered upon the keycap body, the adhesive layer having at least one color;

an electroplated layer, covered upon the adhesive layer; and a protecting layer, covered upon the electroplated layer;

wherein the adhesive layer is for making a surface of the keycap body smooth so that the electroplated layer is closely adhered above the surface of the keycap body, and after a part of the protecting layer and the electroplated layer is removed, a cave is formed on the keyswitch surface to show the at least one color.

11. The input apparatus of claim 10, the input apparatus is a keyboard.

12. The input apparatus of claim 10, wherein the adhesive layer is covered upon the keycap body via a spray coating method.

13. The input apparatus of claim 10, wherein the at least one color is formed upon the adhesive layer via a dyeing method.

14. The input apparatus of claim 10, wherein the electroplated layer is covered upon the adhesive layer via a water plating method.

15. The input apparatus of claim 10, wherein the electroplated layer is covered upon the adhesive layer via an evaporative deposition method.

16. The input apparatus of claim 10, wherein the electroplated layer is covered upon the adhesive layer via a sputtering deposition method.

17. The input apparatus of claim 10, wherein the protecting layer is used to increase an abrasion resistance of the keyswitch.

18. The input apparatus of claim 10, wherein the part is removed via a laser etching method to form the cave.

19. The input apparatus of claim 10, wherein the shape of the cave disposed upon the keyswitch surface corresponds to a specific pattern of the specific keyswitch.

* * * * *